United States Patent [19]

Lawson, Jr.

[11] 4,073,559

[45] Feb. 14, 1978

[54] ELECTRICAL CONNECTOR FOR SUBMERSIBLE OIL WELL PUMP CABLES

[76] Inventor: William H. Lawson, Jr., 4715 Webb Canyon Road, Claremont, Calif. 91711

[21] Appl. No.: 808,327

[22] Filed: June 20, 1977

[51] Int. Cl.[2] ..... H01R 13/52

[52] U.S. Cl. ..... 339/94 R; 174/88 R; 174/91; 339/136 R

[58] Field of Search ..... 339/89, 94, 136, 137; 174/88 R, 88 C, 91

[56] References Cited

U.S. PATENT DOCUMENTS

| | | | |
|---|---|---|---|
| 2,934,586 | 4/1960 | Gesell | 174/88 C |
| 3,079,580 | 2/1963 | Paasche | 339/94 R |
| 3,188,382 | 6/1965 | Fuss | 174/91 |

FOREIGN PATENT DOCUMENTS

| | | | |
|---|---|---|---|
| 842,418 | 7/1960 | United Kingdom | 339/94 R |

*Primary Examiner*—Joseph H. McGlynn
*Attorney, Agent, or Firm*—Lawrence Fleming

[57] ABSTRACT

An in-line connector for electrical cables used to conduct power to submersible pumps located down-hole in oil wells. The cable may be divided into lengths or sections a few hundred meters long, joined in series by the connectors, so that defective sections of cable can be replaced at the well site. Such cables typically comprise three heavy gauge conductors with high-temperature insulation and an outer wrapping of interlocking steel armor. The novel connectors are smooth in profile and sealed against the entry of fluids. The cable armor is preferably soldered into the ends of the connectors.

8 Claims, 6 Drawing Figures

FIG. 1.
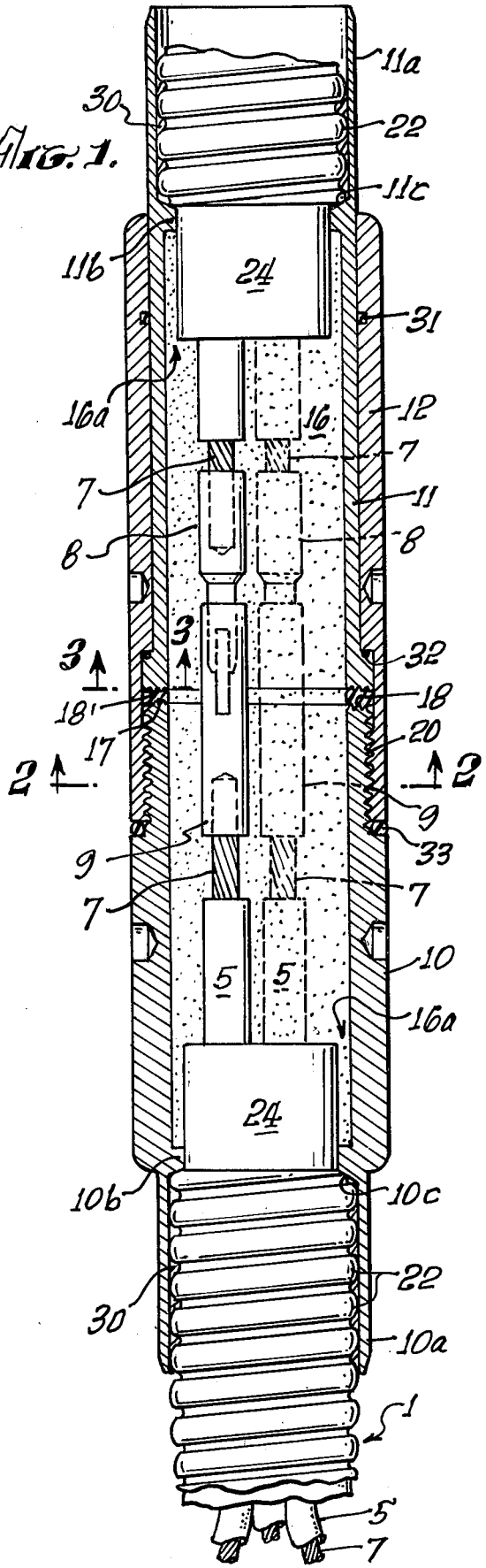
FIG. 2.
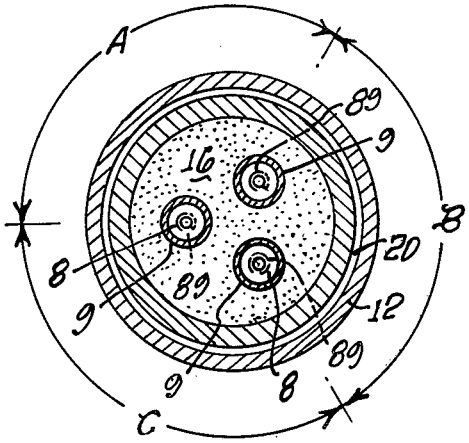
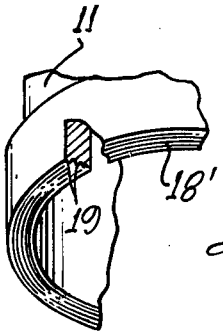
FIG. 3.

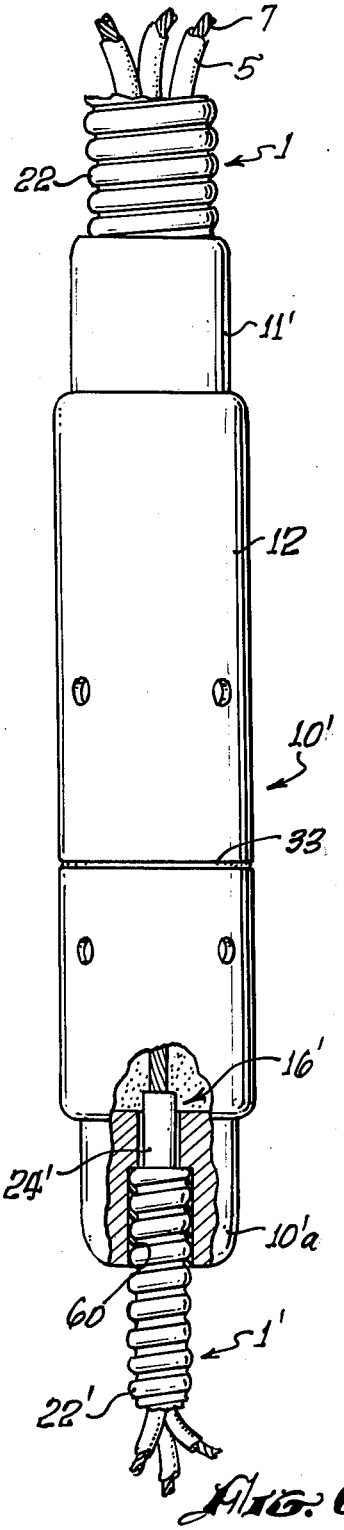
FIG. 6.
FIG. 4.
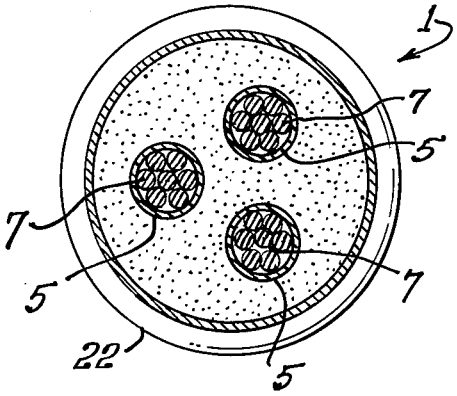
FIG. 5.
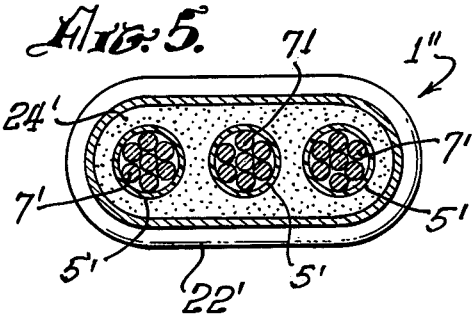

ELECTRICAL CONNECTOR FOR SUBMERSIBLE OIL WELL PUMP CABLES

BACKGROUND

Electric pumps are often used down-hole to pump oil from oil wells. The power is conducted to such a pump by an armored cable which is mechanically strapped at intervals tightly along the outside of the well tubing. A typical pump, attached near the bottom of the tubing string, may be about 11 cm in diameter and 7 m long, and draw about 300 kw at 1000 volts, 3-phase a-c. A group of about 1000 wells in the area near Long Beach harbor, Calif., ranges from about 700 m to 2700 m deep, and employs a total of about 1300 km of such cable. Several 2000 m reels of cable are used per month for replacement purposes.

It has been the practice to install such well cable in one continuous length for each well, with or without permanent splices. When an electrical defect occurs, such as a short or open circuit or excessive insulation leakage, the whole cable is pulled out of the hold and the bad sections cut out at a repair facility and new sections of cable spliced in; the cable is then returned to service. Such cables are exposed in the well to gas, oil, and salt water at high temperatures and pressures. They are also subject to mechanical damage, particularly when the tubing string is being run into or out of an angled hole.

Since at present it is necessary to truck a whole cable to a repair facility, the time required is considerable and a substantial stock of spare cables—cut to length—must be maintained near the well site. If however, the cable is in sections of, say 300 m long, joined by detachable connectors, it is then possible to identify and replace defective sections at the well site, at a substantial reduction in maintenance cost. Heretofore, this more economical procedure has not been feasible because suitable connectors were not available.

BRIEF SUMMARY

This invention comprises a rugged sealable connector for joining sections of armored electrical cable end to end, primarily for use in oil wells. The connector is made in three main parts: two coaxial cylindrical shells and a threaded sleeve which draws and holds the two shells together in alignment and seals them against entry of fluids. The outside of the assembled connector is generally slender and smooth in contour except for spanner recesses, to avoid catching on the well casing as the tubing string is lowered down the hole.

The outer end of each of the two shells is recessed for several cm to receive and fit closely around the end portion of the cable armor. The armor is preferably soldered therein. The insulating jacket and the cable conductors (usually three in number) extend beyond the end of the armor into the interior of the connector shell. Suitable male and female connector pins are soldered or otherwise secured to the ends of the conductors. The shell interiors are then potted around the connector pins (leaving their ends exposed), preferably with a potting material similar to the jacket material, while the pins are held in suitable jigs to insure proper location and alignment for connection.

A deformable washer, e.g., of lead, is preferably installed between the abutting annular faces of the two shells. When the threaded sleeve is screwed tight, the washer is compressed, sealing the connector interior against the intrusion of fluids in the well.

DETAILED DESCRIPTION in the drawing:

FIG. 1 is a longitudinal sectional view of a connector according to the invention;

FIG. 2 is a section on line 2—2 of FIG. 1;

FIG. 3 is a partial sectional perspective view on line 3—3 of FIG. 1;

FIG. 4 is a sectional view of a round cable;

FIG. 5 is a sectional view of a flat cable; and

FIG. 6 is a side view, partly cut away, of a connector joining a round cable to a flat cable.

In FIG. 1, the connector comprises a threaded shell 10 with external threads indicated at 20 and a mating end face portion 18. A second, unthreaded shell 11 has a mating end face 18'. These flat annular faces 18, 18' may each be provided with circumferential grooves as indicated at 19 in FIG. 3. Returning to FIG. 1, a deformable, e.g., lead, sealing washer 17 is preferably disposed between the faces 18, 18'.

The faces 18, 18' are forced together and the two shells 10, 11 are held in alignment by a threaded sleeve 12 which has internal threads engaging at 20 the external threads on the first shell 10. The deformable washer 17 is thereby compressed, conforming to the grooves 19 and sealing the shells 10, 11 against the entry of fluids. The threads 20 may be tightened by means of suitable spanners, not shown, engaging spanner recesses 14 in shell 10 and sleeve 12. O-rings 31, 32, 33 may be provided as additional seals, but are not usually necessary.

In assembly, the ends of the armored cable 1 are stripped and the armor 22 cut back several cm, FIG. 1. A cable end is then inserted into the outer end sleeve portion **10*a* or 11*a* of a connector shell 10 or 11. Shells 10, 11 are provided with short portions of reduced diameter 10*b*, 11*b*, which fit closely around the cable jacket 24 and define outer shoulders 10*c*, 11*c*. The inner ends of the armor 22** abut these shoulders.

The inner boundaries of the reduced-diameter portions **10*b*, 11*b* define the ends of interior spaces around the cable jacketing 24 which are to be filled with potting compound, as at 16*a***, FIG. 1.

The armor 22 is preferably soldered into the shell end portions **10*a*, 11*a* as indicated at 30** in FIG. 1. These shell end portions have walls thinner than the central portions, as shown, to facilitate heating for soldering. These walls may be about 1.6 mm thick. Their total sectional area, is, however, of the order of 3 $cm^2$, which is enough to withstand a tensile load of several tons, comparable to or greater than the strength of the cable itself. In practice, the cable is not subjected to extraordinary tension because it is tightly strapped to the side of the well tubing (not shown) at intervals of a few meters.

As described earlier, the insulating jacket 24 of cable 1 extends a few cm into the interior of the connector, FIG. 1, and the insulated conductors 5, 7 a few cm farther, the conductor ends 7 being bared.

For clarity of illustration, FIG. 1 shows only two conductors in the interior of the connector body. It will be understood that in practice there are usually three conductors and three pairs of connector pins.

As noted earlier, in assembling the end of a cable to one half of a connector such as shell 10 or 11, the armor 22, jacket 24, and conductor insulation 5 are first stripped back in the manner shown in FIG. 1. The connector pins 8 or 9 are then soldered or otherwise suitably attached to the ends of conductors 7. The next and final steps are soldering the armor and potting the interiors. The soldering operation may be effected in a suitable known manner to provide hermetically sealed solder joints between the armor and the inside of the shell end portions 10*a*, 11*a*, as indicated at 30, FIG. 1.

The potting step comprises holding the connector pins in a suitable jig means (not shown) and forcing a suitable potting compound 16, FIG. 1, into the space around the pins, the conductors, and the cable jacketing 24, including the annular spaces 16*a*. The potting compound is then cured in place, as by a catalyst or by heat. Preferably the potting compound is similar to or bondable to the cable jacket material 24, which may typically be a silicone rubber or a high-nitrile rubber.

The potting compound should not extend so high as to interfere with the mating of the connector pins 8, 9; the pin ends must be left suitably exposed.

FIG. 2 is a sectional view on line 2—2 of FIG. 1 showing the mated connector pins 8, 9 in section. The jig (not shown) used during potting may preferably be shaped so as to hold the pins in an uneven spacing so that the connector halves can be plugged together in only one angular relation. Thus in FIG. 2 angles A and B may for example be each 125° and angle C 110°. A relative rotational error in mating may reverse one phase of the three-phase power, causing the pump motor to run backward. Alternatively, a suitable known type of mechanical key (not shown) may be provided to key the connector shells together in fixed angular relation.

The connector pins 8, 9 do not form a part of the invention. One suitable type of pin is made of copper and is manufactured by the Multilam Corporation of Los Altos, Calif. These pins are provided with axial tapped holes, which are indicated at 89 in FIG. 2.

A typical round cable is shown in section in FIG. 4. Its three conductors 7 may be of about No. 0 to No. 2 AWG stranded copper wire. The conductor insulation 5 may be of a fluoropolymer material. The jacket 24, molded around the three insulated conductors, to withstand high temperatures. The interlocking wrapped armor 22 may be of galvanized steel, its outside diameter about 38 mm.

The pins 8, 9 are engaged when the two shells 10, 11 are brought together, and sealed by compression of the deformable washer 17 when the sleeve 12 is screwed tight.

FIG. 5 shows a simplified sectional view of a flat type of cable 1' which is often used to conduct power to submersible pumps in oil wells. Its elements are similar to those of the round cable of FIG. 4: conductors 7' with conductor insulation 5'; an insulating jacket 24', and wrapped interlocking metallic armor 22'.

A connector assembly according to the invention may be employed to connect flat cable to round cable. FIG. 6 shows such an assembly. The end of the round cable 1 may be installed with connector pins in the shell 11' in the same manner as in FIG. 1. The flat cable 1' may be installed, with connector pins, into the lower shell 10' in a generally similar manner. The armor-receiving sleeve end portion 10'*a*, FIG. 6, is however, shaped internally to fit the armor of the flat cable, as by having an elongated milled hole or like opening 60. An adapter may be provided having a round external surface to fit into a round shell end portion such as 10*a* (FIG. 1) and an elongated internal hole to fit the flat cable. This may be soldered in place.

Flat and round cable may have different types of jacket materials; one may be high-nitrile rubber for example, and the other silicone rubber. It is not feasible to splice such different types together. However, with a connector of the invention they may be satisfactorily joined. The connector shell 10', FIG. 6, may be potted with the same material as the jacket 24', and the shell 11' with the same material as the jacket of cable 1. Thus, the present connector will join cables of different sectional shapes, and also cables having different jacket materials.

I claim:

1. A disconnectable connector for electric power cable of the type having insulated conductors, a jacket, and metallic outer armor, comprising:

a first shell having a cable end receiving portion, external threads, and a generally annular end face portion;

a second shell having a cable end receiving portion and a generally annular end face portion;

a sleeve fitting over said second shell and having internal threads engageable with said external threads to draw said shells axially together and force said face portions together; and a deformable sealing washer between said face portions, said cable end receiving portions having internal dimensions to fit said armor and adapted to soldering said armor thereinto;

electrical connector pins on the ends of said conductors inside said shells, and potting material inside said shells surrounding portions of said pins, the outer diameters of said first shell and said sleeve being substantially the same to present a smooth outer contour.

2. A connector as in claim 1, wherein:

said connector is adapted to join two cables having different jacket materials, each said shell having a different potting material which is bondable to the jacket material of its respective cable.

3. A connector as in claim 1, wherein:

said connector is adapted to join a round cable to a flat cable, one said cable end receiving portion having an inner diameter to fit said round cable, and the other said cable end receiving portion being shaped internally to fit said flat cable.

4. A connector as in claim 1 further comprising:

a ring-shaped portion of reduced diameter inside each said shell, said diameter fitting said jacket and serving to provide a shoulder-like stop means to limit the ingress of said armor, and defining the end of an internal space in each said shell for said potting compound.

5. A connector as in claim 4 further comprising:

spanner recesses in said first shell and said sleeve for the reception of a spanner tool to tighten said threads.

6. A connector as in claim 5 wherein:

each said cable end receiving portion has a wall thickness of between about 1 and 2 mm and a substantially smaller outside diameter than the remainder of said first shell and said sleeve, the two diameters being joined by a rounded shoulder portion to present a non-snagging contour.

7. A cable connector and joint comprising:

a flexible electric power cable for use down-hole in oil wells and having conductors with high-temperature insulation and helically-wrapped outer metallic armor; and a disconnectable connector joining sections of said cable end to end, said connector comprising a first shell having a cable end armor-receiving portion, external threads, and a generally annular end face portion, a second shell having a cable end armor receiving portion and a generally annular end face portion, a sleeve fitting over said second shell and having internal threads engagable with said external threads to draw said shells axially together and force said face portions together, a deformable soft metallic sealing washer between said face portions, a hardened fluid sealant between the end portion of said armor and the inner surface of each said receiving portion bonding and sealing said armor therein;

said connector further comprising electrical connector pins on the ends of said conductors inside said shells, and potting material inside said shells sealable to the insulation on said conductors and surrounding substantial portions of said pins and holding them in position, the outer diameters of said first shell and said sleeve being substantially the same to present a smooth outer contour.

8. A cable connector and joint as in claim 7, wherein: said sealant is a metallic solder.

* * * * *